US008790038B2

(12) United States Patent
Stachowicz et al.

(10) Patent No.: US 8,790,038 B2
(45) Date of Patent: Jul. 29, 2014

(54) EXPANSION JOINT AND METHODS OF PREPARING SAME

(71) Applicant: Dynamic Surface Applications, Ltd., Pennsdale, PA (US)

(72) Inventors: Michael F. Stachowicz, Wilbraham, MA (US); Richard P. Lee, Canton, OH (US)

(73) Assignee: Dynamic Surface Applications, Ltd., Pennsdale, PA (US)

( * ) Notice: Subject to any disclaimer, the term of this patent is extended or adjusted under 35 U.S.C. 154(b) by 0 days.

(21) Appl. No.: 13/691,079

(22) Filed: Nov. 30, 2012

(65) Prior Publication Data

US 2014/0154008 A1 Jun. 5, 2014

(51) Int. Cl.
*E01C 11/02* (2006.01)

(52) U.S. Cl.
USPC ..... 404/47; 404/49; 404/51; 404/56; 404/68; 52/393

(58) Field of Classification Search
CPC ..... E04F 15/14; E01D 19/06
USPC ..... 404/47–69; 52/393
See application file for complete search history.

(56) References Cited

U.S. PATENT DOCUMENTS

| | | | | |
|---|---|---|---|---|
| 4,042,992 | A * | 8/1977 | Hyslop | 14/69.5 |
| 4,324,504 | A | 4/1982 | Cottingham et al. | |
| 4,601,604 | A * | 7/1986 | Clark et al. | 404/69 |
| 4,784,516 | A * | 11/1988 | Cox | 404/69 |
| 4,823,452 | A | 4/1989 | Cloutier | |
| 4,876,759 | A | 10/1989 | Yang | |
| 5,024,554 | A | 6/1991 | Benneyworth et al. | |
| 5,190,395 | A * | 3/1993 | Cathey et al. | 404/74 |
| 5,513,927 | A | 5/1996 | Baker et al. | |
| 5,664,906 | A | 9/1997 | Baker et al. | |
| 6,039,503 | A | 3/2000 | Cathey | |
| 6,358,621 | B1 | 3/2002 | Hughes et al. | |
| 2010/0281807 | A1 | 11/2010 | Bradford | |

OTHER PUBLICATIONS

Dynamic Surface Applications, Ltd., Specification for the Installation of the Thorma-Joint® Asphaltic Plug Expansion Joint System, Revised Feb. 2012, 4 Pages.
Dynamic Surface Applications, Ltd., Thorma-Joint® Product Description, Published prior to the filing date of the subject application, 2 Pages.

(Continued)

*Primary Examiner* — Raymond W Addie
(74) *Attorney, Agent, or Firm* — Calfee, Halter & Griswold LLP

(57) ABSTRACT

An expansion joint formed within a channel between two adjacent road surfaces and a method of preparing an expansion joint. The joint is formed within a channel having sides each extending from an adjacent road surface to a bottom side of the channel. The joint construction may include at least one layer of a binder covering at least a portion of the sides of the channel, and one or more layers of aggregate chips and the binder covering the at least one binder layer so as to fill the channel to at least the top of the road surface. The cumulative surface area of the two channel sides may be greater than the cumulative surface area of two channel sides each planar and perpendicular to the bottom. The joint construction may include a plate on the bottom side of the channel. The joint construction may include a flexible sheeting between the plate and the at least one binder layer.

20 Claims, 7 Drawing Sheets

(56) References Cited

OTHER PUBLICATIONS

Dynamic Surface Applications, Ltd., Thorma-Joint® Product Description, http://www.dsa-ltd.com/thorma-joint, Published prior to the filing date of the subject application, 3 Pages.

Dynamic Surface Applications, Ltd., Specification for the Installation of the Thorma-Joint® Asphaltic Plug Expansion Joint System, Revised May 2010, 5 Pages.

International Search Report and Written Opinion from PCT/US2013/072011 dated Jan. 17, 2014.

* cited by examiner

EXPANSION JOINT AND METHODS OF PREPARING SAME

BACKGROUND

Elevated and supported roadways offer more construction challenges than standard surface streets and highways. Supported roadways, such as for example, bridges, overpasses, ramps, parking decks and parking garages, are built to include two or more deck sections, each section constructed of concrete. The decks are supported on pillars, typically at the junction of two adjacent deck sections. Gaps are intentionally left between adjacent deck sections to allow for deck movement caused by various factors, such as changes in weather or settling of the pillars over time. The width of a gap may vary from bridge to bridge, and in a bridge having more than one gap, from gap to gap. Each gap is subsequently filled by a joint.

The joints constructed between the decks must also allow for movement of the adjacent decks. Conventional joints are typically made of a different composition than the asphalt surface of the roadway. One type of joint is constructed of aggregate chips and a binder. The mix of chips and binder are placed in a channel cut into an asphalt layer which has been previously applied on top of the concrete decks. The channel is generally centered over a gap between two adjacent decks.

SUMMARY

The present application describes an expansion joint formed within a channel between two adjacent road surfaces and a method of preparing an expansion joint.

In an exemplary embodiment, an expansion joint is formed within a channel between two adjacent road surfaces. The channel has two non-parallel sides each extending from an adjacent road surface to a bottom side of the channel. The joint may or may not include a plate or other structure on the bottom side of the channel (covering the gap underneath); at least one layer of a binder covering the plate, the bottom and at least a portion of the sides of the channel; and one or more layers of aggregate chips and/or binder covering the at least one binder layer so as to fill the channel to at least the top of the road surface.

An exemplary method for preparing an expansion joint is also described. The expansion joint is prepared within a channel between two adjacent road surfaces, with a gap at the bottom of the channel. The method includes preparing the channel into a shape having two non-parallel sides, which may be trapezoidal; each side extending from an adjacent road surface to a bottom side of the channel at an angle to the bottom side; placing a backer rod within the gap; covering at least a portion of the bottom side and at least a portion of the sides of the channel with at least one layer of a binder; and placing one or more layers of aggregate chips and/or binder into the channel over the at least one binder layer so as to fill the channel to at least the top of the road surface.

BRIEF DESCRIPTION OF THE DRAWINGS

Features and advantages of the general inventive concepts will become apparent from the following detailed description made with reference to the accompanying drawings.

DETAILED DESCRIPTION

Figure 1:
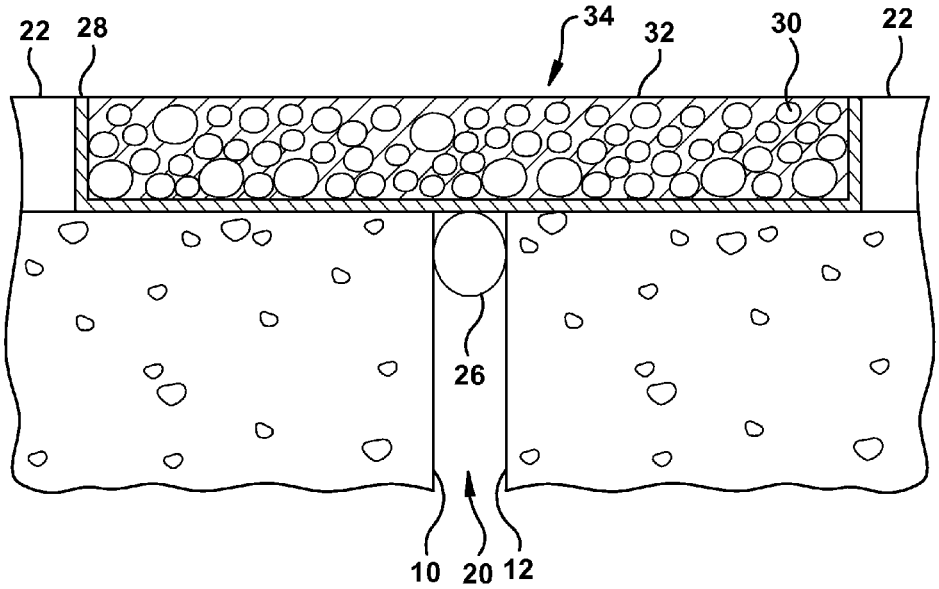
Figure 1 (Prior Art)
FIG. 1 is a sectional view of a prior art bridge joint, showing a completed joint.

This Detailed Description merely describes exemplary embodiments in accordance with the general inventive concepts and is not intended to limit the scope of the invention or the claims in any way. Indeed, the invention as described by the claims is broader than and unlimited by the exemplary embodiments set forth herein, and the terms used herein have their full ordinary meaning.

The general inventive concepts will now be described with occasional reference to the exemplary embodiments of the invention. This general inventive concept may, however, be embodied in different forms and should not be construed as limited to the embodiments set forth herein. Rather, these embodiments are provided so that this disclosure will be thorough and complete, and will fully convey the scope of the general inventive concepts to those skilled in the art.

Unless otherwise defined, all technical and scientific terms used herein have the same meaning as commonly understood by one of ordinary skill in the art encompassing the general inventive concepts. The terminology set forth in this detailed description is for describing particular embodiments only and is not intended to be limiting of the general inventive concepts. As used in this detailed description and the appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about." Accordingly, unless otherwise indicated, the numerical properties set forth in the specification and claims are approximations that may vary depending on the suitable properties sought to be obtained in embodiments of the present invention. Notwithstanding that the numerical ranges and parameters setting forth the broad scope of the general inventive concepts are approximations, the numerical values set forth in the specific examples are reported as precisely as possible. Any numerical values, however, inherently contain certain errors necessarily resulting from error found in their respective measurements.

The present application describes, in part, an expansion joint between two adjacent road surfaces and a method of preparing the expansion joint. The filled joints and related methods can be applied to new joints, i.e., construction of a new bridge or road, and to existing joints during a repair process. The expansion joint is formed at least partially within a channel having non-perpendicular sides relative the bottom of the channel. The shape of the sides advantageously increases the bondable surface area of the channel side and increase the tensile adhesion of the joint. In one exemplary embodiment, the channel is cut into a layer of rolled asphalt to have channel sides that are at an angle of 110 degrees to 180 degrees from the channel bottom. In another exemplary embodiment, the channel is cut into a layer of rolled asphalt to have channel sides that are at an angle of 135 degrees from the channel bottom. In another exemplary embodiment, the cut channel is greater than 90 degrees relative to the channel bottom.

The term "joint" is sometimes used in the art of road surface construction to mean the zone of juncture between bridge road members which may move relative to one another. That term is also used to mean the material of the roadway proximal the juncture of bridge members. The term "joint" is used in both senses in this application and those skilled in the art will have no difficulty in differentiating between the meanings to be given the term from the context in which the term is used.

Figure 2:
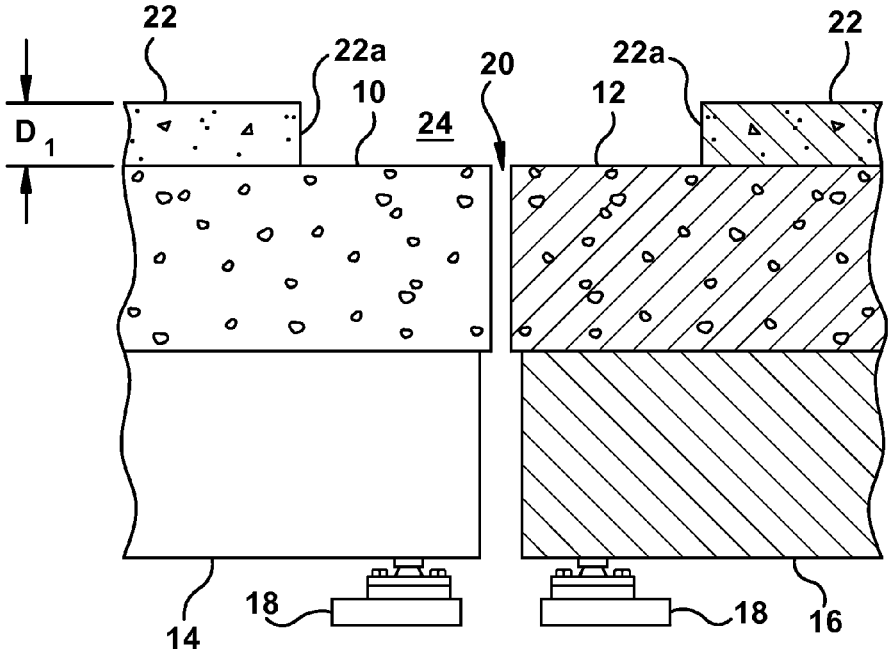
Figure 2 (Prior Art)
FIG. 2 is a sectional view of the bridge joint of FIG. 1, showing the bridge joint in partially complete form with a channel formed at a gap between two adjacent structural members.

Referring now to the drawings, a prior art bridge joint is illustrated in FIGS. 1 and 2. The bridge joint is described in U.S. Pat. No. 5,513,927 to Baker et al. and U.S. Pat. No. 5,664,906 to Baker et al., each of which are incorporated herein in their entireties, to the extent either is not conflicting with the present invention. As seen in FIG. 2, the exemplary bridge includes a series of end to end structural members, such as a slab 10 and a slab 12, supported by a series of end to end girders, such as a girder 14 and a girder 16. Similarly, the girders are supported by support members such as pillars 18, which extend from ground level to the elevated position of the slabs they support.

Adjacent structural members, including slabs 10 and 12 and girders 14 and 16, are spaced apart such that a gap 20 exists between the members. The gap 20 accommodates normal movement of the members, such as for example, by contraction and expansion due to temperature variations. Depending on bridge size, a bridge may have 1 inch or more of movement at a gap. A bridge joint prohibits road surface cracking above or near the gap. Although a single gap 20 is shown in FIG. 1, it will be understood that most bridges include a plurality of such gaps, where the number of gaps corresponds to the number of junctions between adjacent structural members.

A roadway including a layer 22 of bituminous paving material, or asphalt, is normally placed as a continuous band of uniform thickness extending from one end of the bridge to the other and across the gaps 20 at each junction between adjacent members. The layer 22 also extends across the entire width of the bridge. A portion of the layer 22 shown in FIG. 2 has been cut and removed to create a channel 24 in which a bridge joint may be constructed. A shown, the sidewalls of the channel 22*a* are perpendicular with the bottom of the channel, which is defined by the top of the slabs 10, 12.

After construction of the channel 24, an oversized cylindrical backer rod 26 is generally fitted in gap 20 just below channel 24. A primer 28 is applied to the channel 24 so that a thin film of primer 28 is uniformly distributed on the sides and bottom of channel 24. Next, a plurality of aggregate chips 30 are placed in channel 24 until the top layer of chips is substantially one-quarter inch below the top of channel 24. An elastomeric binder 32 is applied to the aggregate chips 30 located in channel 24. As the binder 32 is poured into the channel 24, a binder and aggregate mixture 34 is formed.

Referring now to FIGS. 3-8*h*, an inventive expansion joint and method of making the joint will be discussed. The expansion joint may be utilized in any application between two adjacent road surfaces separated by a gap. The exemplary expansion joint illustrated in FIGS. 3-7 is a bridge expansion joint. It will be understood by one with skill in the art that the application of the expansion joint may vary in the practice of the invention, such as for example, overpasses, ramps, parking decks and parking garages.

Figure 3:
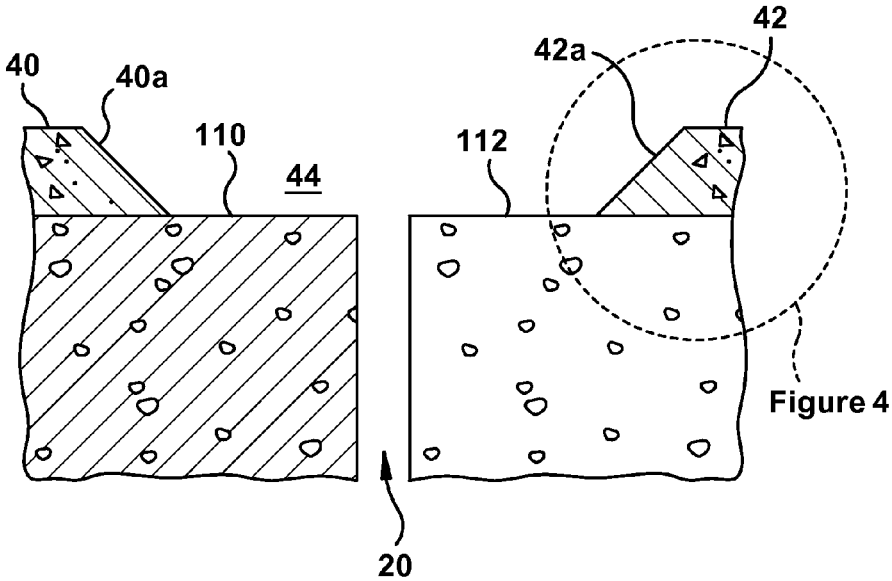
FIG. 3 is a sectional view of an embodiment of a partially complete expansion joint according to the present disclosure, showing a channel formed at a gap between two adjacent structural members.

Referring now to FIG. 3, one exemplary embodiment of a partially complete expansion joint is shown. The sectional view illustrates a first concrete deck 110, a second concrete deck 112, and a divided asphalt road surface 40, 42. After paving of the asphalt, a cut between each road surface 40, 42 forms a channel 44 defined by the top surfaces of each adjacent deck 110, 112 and channel sides 40*a*, 42*a*. The cut exposes a gap 20 below the channel 44 and between the two adjacent decks 110, 112. As shown, each channel side 40*a*, 42*a* extends from the road surface 40, 42 to the deck 110, 112, respectively. The channel sides are planar and angled relative to the deck 110, 112. It will be understood by one with skill in the art that the shape, length and size of each channel side may vary in the practice of the invention, such as for example, the channel side may be concave, as shown in FIG. 8*h*.

The channel sides are formed to add adhesion strength to the filled joint as compared to a joint have a vertical wall channel side, as in FIGS. 1-2. Specifically, each channel side 40*a*, 42*a* is of a length greater than the channel sides 22*a* of FIG. 2. With a greater length, the surface area of each channel side is more than the surface area of the channel sides 22*a*, with surface area being measured by length multiplied by width of the asphalt surface 40, 42, respectively.

Figure 4:
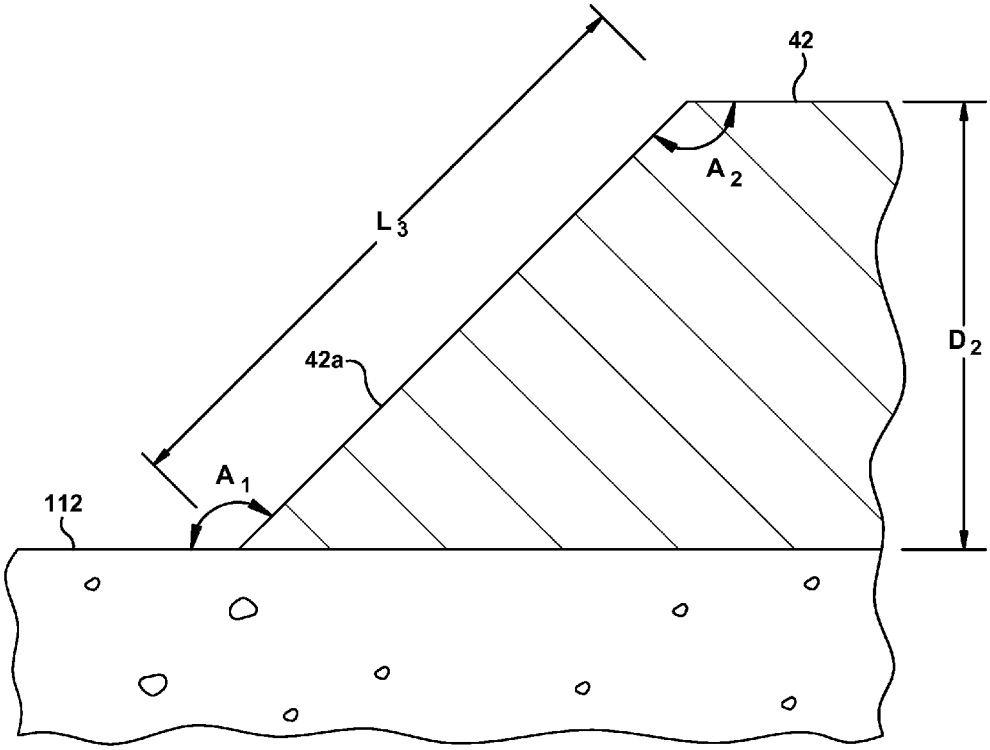
FIG. 4 is an enlarged sectional view of the designated circular area of FIG. 3.

The difference in surface area of two channel sides having different lengths is easily calculated. For example, if the channel side 22*a* in FIG. 2 is a length $D_1$ of 3 inches, i.e., 0.25 feet, and the asphalt layer 22 is 24 feet wide, the surface area of the channel side 22*a* is 6 square feet. The surface area of channel side 42*a* depends on the angle of the channel side relative to the deck surface 112. For example, FIG. 4 is an enlarged sectional view of the designated circular area of FIG. 3. The angle $A_1$ is between 0 degrees and 180 degrees, as measured between the deck 112 and the channel side 42*a*. In one embodiment, $A_1$ is an obtuse angle. In one embodiment, $A_1$ is between 110 degrees and 170 degrees. In the illustrated embodiment, $A_1$ is 135 degrees and $A_2$ is an equivalent 135 degrees. It is apparent from FIG. 4 that as $A_1$ decreases in size, $A_2$ will also decrease in size and $L_3$ will decrease in length, and alternatively, as $A_2$ increases in size, $A_1$ will also increase in size and $L_3$ will increase in length. In the illustrated example, the depth of the road surface $D_2$ is about 3 inches and the length $L_3$ of the channel side is approximately 4.21 inches, i.e., approximately 0.351 feet. In this shape, a channel side with a length of 24 feet, or when the road surface is 24 feet wide, has a surface area of approximately 8.42 square feet, or has approximately 40.33 percent larger surface area of a channel side which is 24 feet long and 3 inches, i.e., 0.25 feet, in length. The exemplary increase in surface area of over 30 percent is believed to increase tensile adhesion of the joint to the channel by over 300 percent compared to the joint depicted in FIG. 2.

Figure 5:
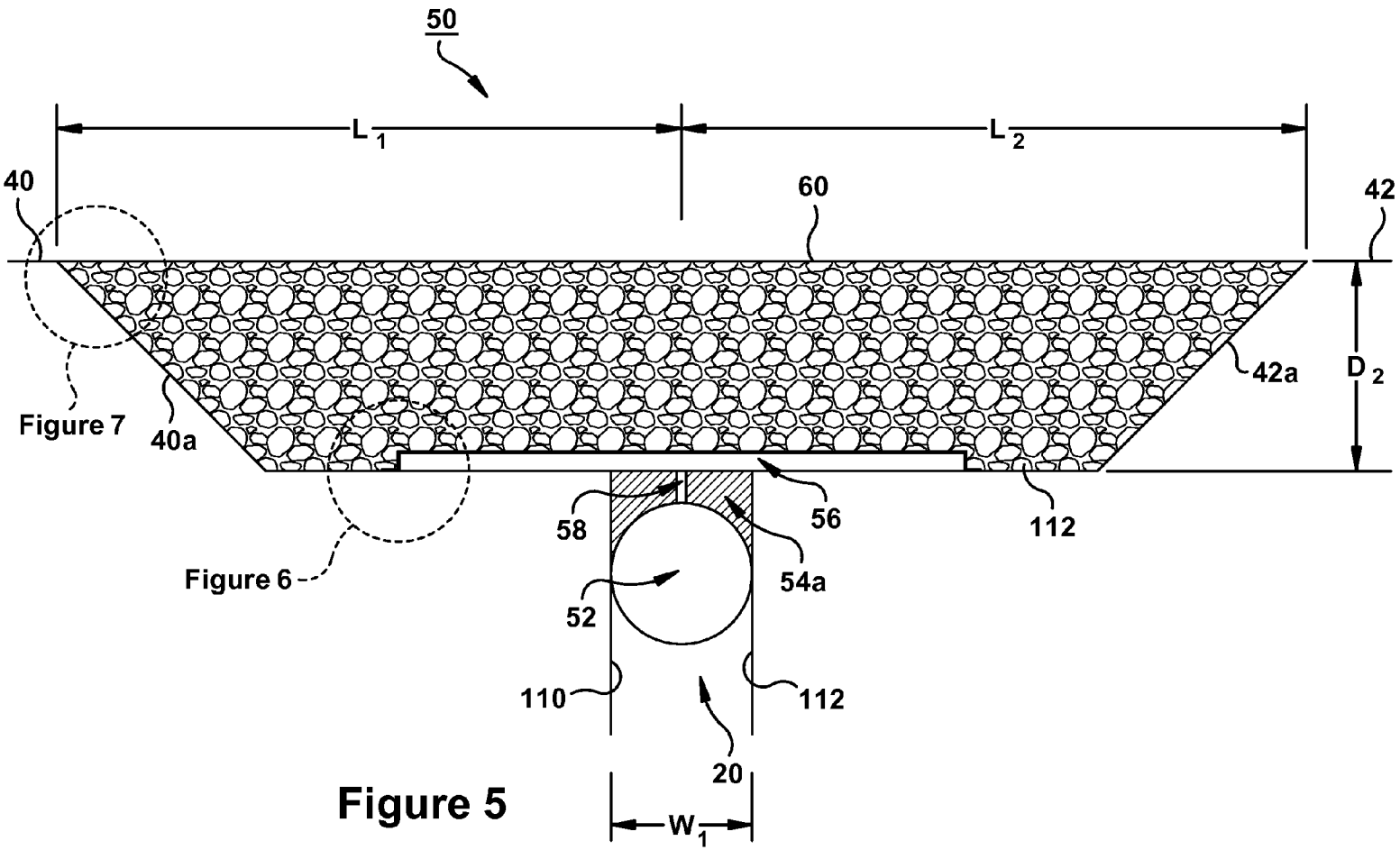
FIG. 5 is a sectional view of the expansion joint of FIG. 3, showing the expansion joint in completed form.
Figure 6:
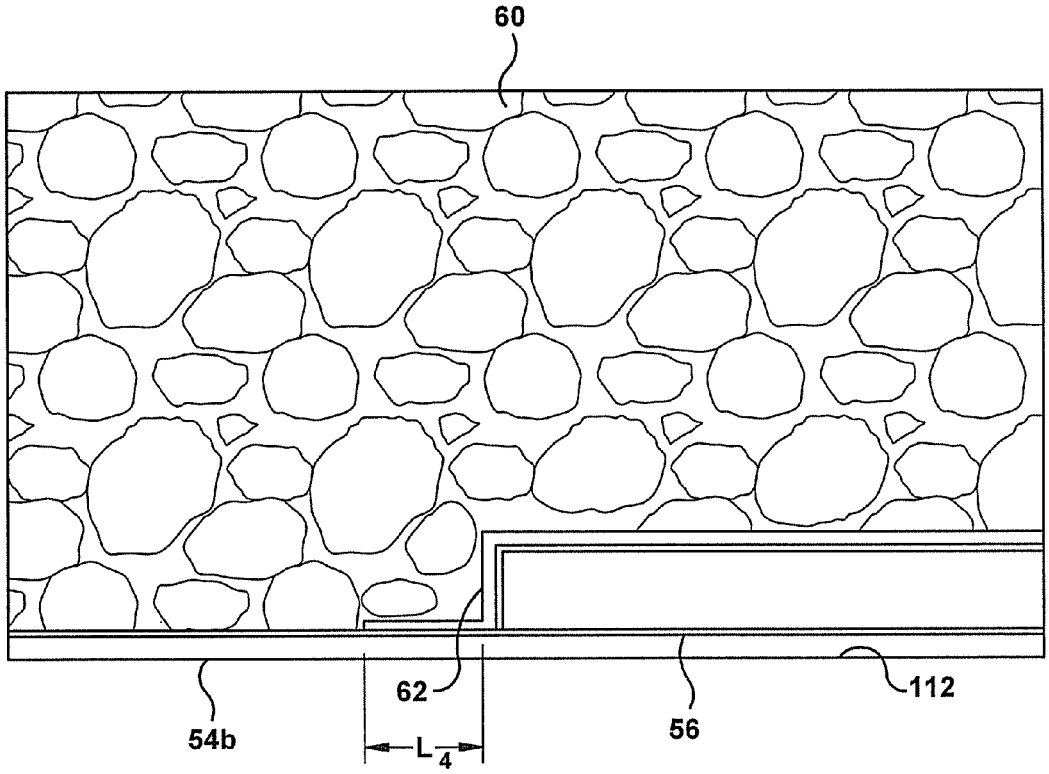
FIG. 6 is an enlarged sectional view of the designated circular area of FIG. 5.
Figure 7:
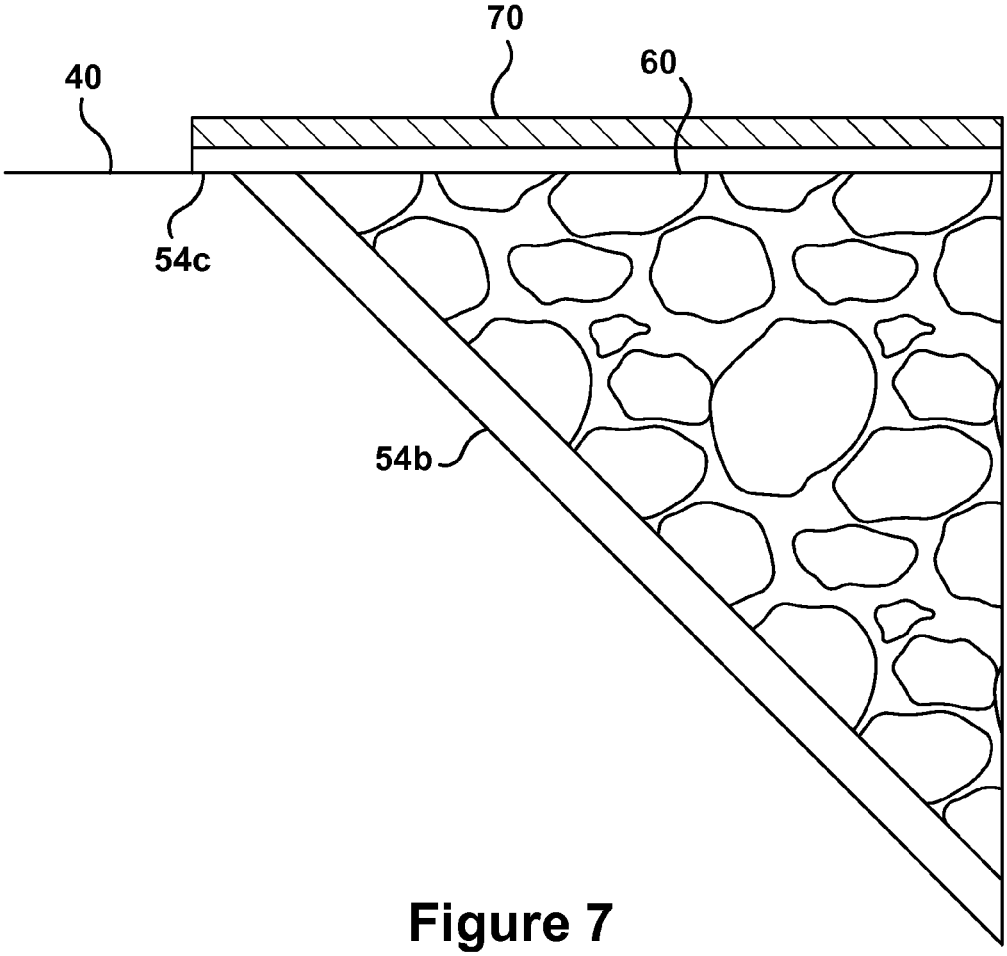
FIG. 7 is an enlarged sectional view of the designated circular area of FIG. 5.

After the channel is formed in the rolled asphalt, the rest of the expansion joint may be completed. Referring now to FIG. 5, a sectional view of an expansion joint is shown prepared within the channel 44 of FIGS. 3 and 4. In the exemplary joint illustrated, the joint is formed using a backer rod, binder, a plate, a flexible sheeting, a mixture of binder and aggregate chips, and an anti-skid material. For clarity, FIG. 5 does not illustrate all of these components. All components can be seen on one or more of FIGS. 5-7. FIGS. 6 and 7 are each enlarged sectional views of the designated circular areas of FIG. 5, respectively.

The gap 20 shown in FIGS. 3 and 4 is partially filled in construction of the expansion joint. As shown in FIG. 5, a cylindrical backer rod 52 is positioned within the gap. The backer rod prohibits any liquid binder from leaking through the gap during joint construction. An exemplary backer rod is constructed of a closed cell foam and shall have heat resistance properties and avoid melting when exposed to temperature, such as for example, binder at 410 degrees F. In the embodiment shown, the backer rod is not an oversized rod. It will be understood by one with skill in the art that backer rod may vary in shape, and that other suitable materials exist for the backer rod.

Above and surrounding the top half of the backer rod 52, a filler is formed between the backer rod and a plate 56. The plate 56 is centered above the backer rod 52 and over the centerline of the gap 20 by a locating pin 58. Each of these components will now be discussed.

The plate 56 as illustrated is centered over the gap 20. The exemplary plate is of a standard size, such as for example ½"×8"×4', and may be constructed of steel, such as A36 mild steel. The width and thickness of the plate may be selected at least in part as a result of the gap 20 width. A number of plates can be positioned and center longitudinally of the gap 20, such as for example, 6 plates each 4 feet long are used with a road surface 24 feet wide. A number of spike holes may be drilled on a longitudinal center line at a convenience interval, such as for example, 1 foot, to allow for placement of a locating pin 58 through the plate and, in the embodiment illustrated, into the backer rod 52. It will be understood by one with skill in the art that plate may vary in shape, size and quantity, such as ½" thick plate, and that other suitable materials exist for the plate, such as for example, aluminum, galvanized steel, stainless steel, or zinc oxide coated steel. Also, structure other than plates may be used in place of a plate to cover the gap, such as for example, a non-flat cap or seal.

The filler 54*a* forms a mechanical bond between the walls of the decks 110, 112, the backer rod 52, the locating pin 58 and the plate 56. An exemplary filler is a binder, such as a asphalt or bitumen based elastomeric material. The material may include thermal plastic polymers, fillers and additives. Discussed herein, the binder 54*a* may be the same material mixed with aggregate chips to fill the channel, and the same material as an applied base layer 54*b* on the surface of the channel bottom and sides and an applied top layer 54*c* on top of the aggregate chips mixture, and in the embodiment illustrated, of a portion of the asphalt surfaces 40, 42 (see FIGS. 6 and 7). The binder is formulated to meet at least the present minimum standards of ASTM D6297. Specifically, the binder when tested independently meets the following standards.

| | |
|---|---|
| Cone Penetration @ 77° F. | 7.5 Max |
| Cone Penetration @ 0° F., | 1.0 Minimum |

-continued

| | |
|---|---|
| Flow @ 140° F., 5 Hours, (MM) | 3.0 Max |
| Non-Immersed Bond @ 20° F., | Pass 3 cycles |
| Resilience @ 77° F. | 40-70% |
| Asphalt Compatibility | Pass |
| Softening Point | 180 Minimum |
| Flexibility/Pliability @ −10° F. | Pass |
| Ductility @ 77° F. | 400% Minimum |
| Tensile Adhesion @ 77° F. | 700% Minimum |
| Recommended Pouring Temp | 390° F. (199° C.) |
| Safe Heating Temperature | 410° F. (210° C.) |

Specifically, an exemplary binder has been tested independently and performed with the following results.

| | |
|---|---|
| Cone Penetration @ 77° F. | 5.1 |
| Cone Penetration @ 0° F., | 1.33 |
| Flow @ 140° F., 5 Hours, (MM) | 0 |
| Non-Immersed Bond @ 20° F., | Pass 3 cycles |
| Resilience @ 77° F. | 53.43% |
| Asphalt Compatibility | Pass |
| Softening Point | 204.84 |
| Flexibility/Pliability @ −10° F. | Pass |
| Ductility @ 77° F. | 757.7% |
| Tensile Adhesion @ 77° F. | 1018% |

It should be understood that many conventional binder compositions including variations upon the above compositions may be suitable for joint construction.

The composition of the binder will now be discussed. The binder is typically composed of several different types of materials. For example, these types of binder products typically contain asphalt or bitumen as their main component. Typical levels of asphalt can vary depending on the grade used and the other components of the product. Exemplary levels may be 65% by weight or as high as 85% by weight, but more typically 65% to 85% by weight. Asphalt used in this application can be of several different paving grades offered by most asphalt producing refineries servicing the paving industry. These asphalt grades are based on the ambient temperatures to which they are expected to be exposed. In addition, asphalt can be graded based on the physical properties that it possesses, such as for example, softening point or viscosity. An example of an asphalt grade of this group that could be used in this application would be 210 flux.

Mixtures of different grades of asphalt listed above in various combinations can be used to achieve the physical properties desired. Proportions of these mixtures are dependent on asphalt sources and their chemical characteristics. Naphthenic, aromatic or parathenic oils can be used to augment the asphalt component to achieve the desired product physical properties. The addition of oil may or may not be needed depending on the chemical characteristics of the asphalt used in this application. Typical addition levels of these types of oils in this application may be 3% to 10% by weight.

Additions of thermoplastic polymers of various types and configurations are often used in this type of product. Addition levels of these polymers can be generally 5% to as much as 15% by weight. Different types of polymers may be used in combination or one type may be used exclusively. Various physical forms of the polymers can be used such as pellet, crumb or powder. Types of polymer that can be used can vary in molecular structure from radial to linear or various hybrids of both types. The chemical components of the polymer used can be in combinations of various styrenes, such as for example, styrene-butadiene-styrene (SBS) or styrene-isoprene-styrene (SIS).

Additions of modified, aromatic and aliphatic hydrocarbon or coumarone indene resins are also used in this binder application. Common addition levels of 2% to 8% by weight have been used, or as little as 2% by weight. Various inert fillers are used in this application such as fly ash, perlite, calcium carbonate or other silica based materials. Addition levels of as much as 15% by weight have been used or as little as 5% by weight, but more typically 5% to 15% by weight have been used. Additives that promote wetting of aggregate, such as for example, anti-stripping agents, have also been used at common additive levels of less than a 1% by weight level.

Referring again to the Figures, the channel 44 may be treated prior to being filled. As seen in the illustrated embodiment of FIGS. 6 and 7, a base layer 54*b* is applied to the bottom and sides 40*a*, 42*a* of the channel. Generally, the base layer 54*b* is the same material as the filler 54*a*. It should be understood that a different material may be used for the base layer, or the expansion joint may be constructed without a base layer.

In certain embodiments, the majority of the channel 44 is filled with an asphalt expansion material, specifically, a mixture of aggregate chips and a filler material. In one embodiment, the aggregate chips are relatively small in size, such as for example, the aggregate chips have a size such that at least 90% by weight of the chips pass through a ⅞" sieve. An exemplary mixture of aggregate chips includes chips of one or more of granite, gabbro, porphyry, basalt and grit stones. The chips are crushed and washed prior to use and in the embodiment discussed herein, prior to use at the application site. It will be understood by one with skill in the art that the composition and size of the aggregate chips may vary.

As discussed herein, aggregate chips are formed in place within the channel 44 with a filler material. In the discussed embodiment, the filler is the same material as the binder 54*a*. In this embodiment, the binder is heated prior to being mixed with the aggregate chips at a ratio of 1 gallon of binder to 100 lbs of aggregate chips, and subsequently pre-coated chips are applied in layers to fill the channel 44. Additional binder is poured into the channel 44 to fill the channel to an approximate 3:1 weight ratio of aggregate chips to binder. It will be understood by one with skill in the art that other pre-coating ratios, and other filling rations may be used.

Another embodiment illustrated in FIG. 6 discloses an additional component to the expansion joint 50. A flexible sheeting 62 is positioned over the plate 56. The flexible sheeting is formed of a heat resistant and pliable plastic, such as for example, neoprene. It is believed the sheeting permits movement of the expansion joint in concert with movement of one or more decks 110, 112. In the embodiment illustrated, no other material is placed between the sheeting 62 and the plate. In an embodiment not illustrated, sheeting 62 is not applied to the plate and a base layer 54*b* of binder is applied to the top of the plate 56 prior to filling the channel with aggregate chips and filler.

Still referring to FIG. 6, the sheeting 62 may extend beyond the plate on top of the bottom of the channel in one or either direction. In one embodiment, the length $L_4$ of extension beyond the plate is 2 inches. It will be understood by one with skill in the art that certain embodiments do not include use of the sheeting, and other suitable heat resistant materials may be used for the sheeting in addition to neoprene.

Additional components of the expansion joint 60 may be used to increase joint performance. Referring again to the embodiment disclosed in FIG. 7, a layer of sealant 54*c* is applied to the top of the mixture 60 of aggregate chips and binder. As discussed, the seal may be the same as the binder 54*a* used below the plate, and the same as the binder 54*b* used as a base layer in the inside surface of the channel 44. In one embodiment, an anti-skid material applied as the uppermost layer of the expansion joint. It will be understood by one with skill in the art that any suitable anti-skid resistant materials may be used, such as for example, black sand.

As discussed herein, the channel sides of the inventive expansion joint are longer than the channel sides of an expansion joint which are perpendicular to the bottom surface of the channel. It will be understood by one with skill in the art that the shape, length and size of each channel side may vary in the practice of the invention. Several different channel sides are illustrated in FIGS. 8*a*-8*h*. These channel sides are offered for example only, and should not be understood to limit the invention. Any channel with at least one non-perpendicular channel side that may be cut into an asphalt layer may be used.

Figure 8A:
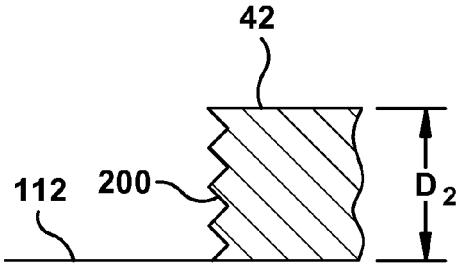
FIG. 8*a* is a sectional view of a portion of a channel, showing a channel side having a scissor-cut shaped surface.

A channel side 200 having a scissor-cut shaped surface is illustrated in FIG. 8*a*. As shown, the channel side extends from the asphalt surface 42 to the deck 112 in an alternating pattern. It will be understood by one with skill in the art that the scissor-cut pattern of the channel side may vary in the practice of the invention.

Figure 8B:
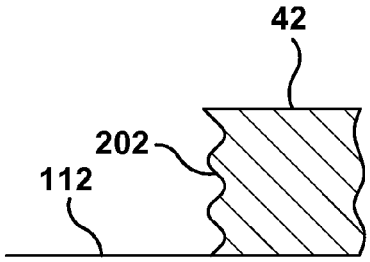
FIG. 8*b* is a sectional view of a portion of a channel, showing a channel side having a sinusoidal shaped surface.

A channel side 202 having a sinusoidal shaped surface is illustrated in FIG. 8*b*. As shown, the channel side extends from the asphalt surface 42 to the deck 112 in an alternating pattern. It will be understood by one with skill in the art that the sinusoidal pattern of the channel side may vary in the practice of the invention, such as for example, the pattern may have more or less cycles per inch.

Figure 8C:
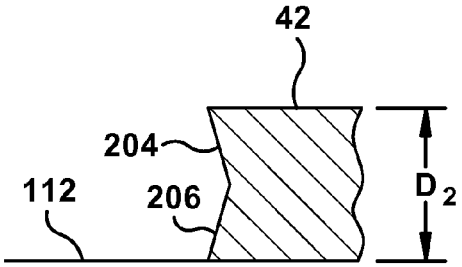
FIG. 8*c* is a sectional view of a portion of a channel, showing a channel side having a V-shaped surface.

FIG. 8*c* is a sectional view of channel with a channel side having a V-shaped surface. An inwardly sloped upper surface 204 and an outwardly sloped lower surface 206 for the channel side. It will be understood by one with skill in the art that the V-shaped pattern of the channel side may vary in the practice of the invention, such as for example, the pattern may be more or less shallow.

Figure 8D:
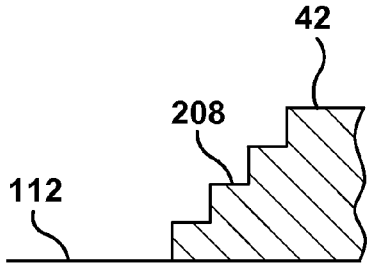
FIG. 8*d* is a sectional view of a portion of a channel, showing a channel side having a step shaped surface.

A channel side 206 having a step shaped surface is illustrated in FIG. 8*d*. As shown, the channel side extends from the asphalt surface 42 to the deck 112 in an alternating pattern. It will be understood by one with skill in the art that the sinusoidal pattern of the channel side may vary in the practice of the invention, such as for example, the pattern may have more or less steps per inch.

Figure 8E:
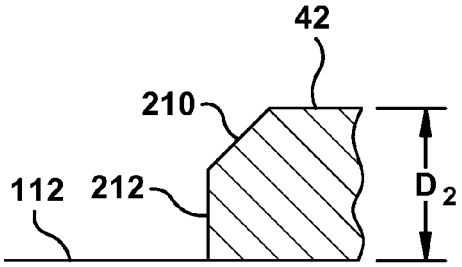
FIG. 8*e* is a sectional view of a portion of a channel, showing a channel side having a partially angled surface.
Figure 8F:
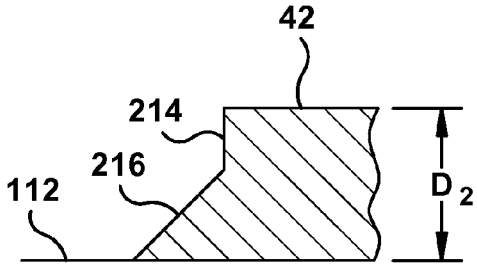
FIG. 8*f* is a sectional view of a portion of a channel, showing a channel side having a partially angled surface.
Figure 8G:
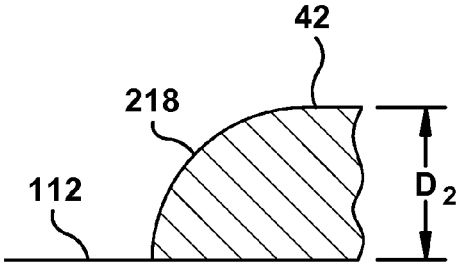
FIG. 8*g* is a sectional view of a portion of a channel, showing a channel side having a concave shaped surface.
Figure 8H:
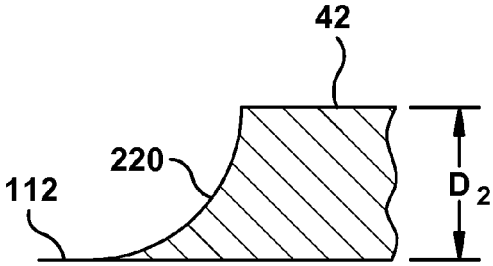
FIG. 8*h* is a sectional view of a portion of a channel, showing a channel side having a convex shaped surface.

The channel side may have an angled portion that does not extend from the asphalt surface uninterrupted to the deck. In FIG. 8*e*, a channel side has an angled surface 210 which extends from the asphalt surface 42 about half way toward the deck 112. A perpendicular surface extends from the angled surface to the deck 112. In FIG. 8*f*, a channel side has a perpendicular surface 214 which extends from the asphalt surface about half way toward the deck 112. An angled surface 216 extends from the perpendicular surface 214 to the deck 112. It will be understood by one with skill in the art that each pattern of these channel sides may vary in the practice of the invention, such as for example, the angled portion may be in the middle of the channel side, between two perpendicular portions.

The channel side may have an angled portion that does not extend from the asphalt surface uninterrupted to the deck. In FIG. 8*e*, a channel side has an angled surface 210 which extends from the asphalt surface 42 about half way toward the deck 112. A perpendicular surface extends from the angled surface to the deck 112. In FIG. 8*f*, a channel side has a perpendicular surface 214 which extends from the asphalt surface about half way toward the deck 112. An angled surface 216 extends from the perpendicular surface 214 to the deck 112. It will be understood by one with skill in the art that each pattern of these channel sides may vary in the practice of the invention, such as for example, the angled portion may be in the middle of the channel side, between two perpendicular portions.

The exemplary shapes of the channel sides to create increased surface area as illustrated by the above descriptions are actually unlimited in number and not limited to those described.

A method of preparing an expansion joint will now be discussed. The embodiment discussed will include steps that are optional and not required in the practice of the invention. Further, other steps discussed herein may be included, but will not be discussed. Further, the expansion joint may be prepared using additional steps not discussed herein.

In one embodiment, an expansion joint is prepared within a channel between two adjacent road surfaces. Preparation of the joint begins at a work site in which a rolled asphalt layer has been previously applied over at least two adjacent structural members. The asphalt layer may be a conventional depth, such as for example, 2 inches or 3 inches. Before the asphalt layer is applied, by either hot-rolling or cold-rolling techniques, a sheeting, such as for example, a waterproof membrane, is typically placed over the length of the driving surface to cover one or more gaps between adjacent structural members, such as for example, concrete bridge decks.

An excavation operation removes the asphalt material above and on either side of the gap to form a channel. As discussed, the channel is defined by a bottom and two channel sides. The excavation operation can be performed by a cutting tool, such as a hand-held saw, or other suitable tool. One or more channel sides have a length greater than the depth of the asphalt. In one embodiment, the channel is cut into a trapezoidal shape having two non-parallel sides, each side extending from an adjacent road surface to a bottom side of the channel at an angle of 100 to 170 degrees from the channel bottom or relative to the channel bottom.

After the channel is cut, the application site is cleaned to remove dirt and road surface particles. Small debris can be removed with the use of compressed air and a blower. Any damage to either exposed deck may be repaired with suitable material.

After cutting and repairing as necessary, the channel side and channel bottom surfaces may be coated with a hot binder along its entire length. As discussed, the binder used may be suitable for use in other operations of preparing the expansion joint. An exemplary pouring binder temperature is less than 400 F, such as for example, somewhere between 350 F and 385 F. It will be understood by one with skill in the art that the specific temperature of the binder will depend on several factors, including but not limited to, the specific composition of the binder.

Product processing parameters for an on-site prepared binder, such as for example, temperature, are dependent on equipment available at the joint construction site. Typically, asphalt is heated to a liquid state and pumped into a mixer tank. If additional liquids are to be added they may be added at this time or later in the batch making process. Typically, thermoplastic polymers are added at this time to be completely dispersed into the asphalt prior to the addition of any further components of the batch. Mixing times will vary with the mixing efficiency of the mixer. High speed disperser may take as little as several hours to disperse polymers. In comparison, low speed mixers may take as much as 24 hours. All other batch components may be added after polymers are fully dispersed.

After the channel has been cut, cleaned, and coated, a caulking operation follows with a heat resistant backer rod being placed within the gap at a depth of at least 1 inch. Above the backer rod, an amount of hot binder is poured to fill the gap to the level of the concrete decks. If the expansion joint is replacing an existing joint, the backer rod operation is not required if the previous chalking remains intact.

A plating operation includes placing a plate or another structure on the bottom side of the channel and over the gap. As discussed herein, one or more plates are used to cover the length of the gap. Once the plates are in place and held, either by locating pins or other suitable techniques, the top of the plate may be covered with at least one layer of a binder. In another embodiment, a flexible sheeting is placed directly over the plate without the application of binder. The sheeting is a heat resistant and pliable plastic and may extend in each direction beyond the plate. Once the joint is constructed, the sheeting will move in either direction against the plate to allow movement of the adjacent members. In other embodiments, neither a binder layer or sheeting is used.

The channel is now prepared and ready for filling. Using an aggregate chip mixture discussed herein, a filler mixture is prepared on-site. The aggregate chips are loaded into a mixer, such as for example, a vented rotating drum. The drum can be prepared for mixing on site by cleaning and heating the drum with a hot compressed air lance. Once the aggregate is heated to a desired temperature, such as for example, 370 F to 380 F, the aggregate is dropped into a second mixer and coated with an amount of binder. As discussed, the binder used may be suitable for use in other operations of preparing the expansion joint.

Layers of this pre-coated aggregate are then applied into the channel. The layers may then be covered with more hot binder. The binder may be added to the layer of pre-coated aggregate chips prior to adding any additional layer of pre-coated aggregate chips. The layers are raked to ensure no air bubbles are trapped. As discussed, in one embodiment the aggregate should be used at a 3:1 weight ratio of the binder. After the aggregate and binder is filled to a level above the asphalt surfaces, such as ¼ inch, the joint is allowed to cool to at least 225 F, and compacted down to a desired level. The joint surface may be compacted with a vibratory plate or roller.

After compaction, a top coating of binder may be placed over the uppermost layer of aggregate chips and binder. Again, the binder used may be suitable for use in other operations of preparing the expansion joint. The top coating extends laterally beyond the uppermost layer of aggregate chips and binder and onto each of the two adjacent road surfaces. Immediately after applying the top coating, an anti-skid material, such as for example, black sand, is placed over the top of the expansion joint.

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof. Unless expressly excluded herein all such combinations and sub-combinations are intended to be within the scope of the general inventive concepts. Still further, while various alternative embodiments as to the various aspects, concepts and features of the inventions (such as alternative materials, structures, configurations, methods, circuits, devices and components, alternatives as to form, fit and function, and so on) may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the general inventive concepts even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. A method for preparing an expansion joint within a channel between two adjacent road surfaces, with a gap at the channel bottom, the method comprising: preparing the channel with two non-parallel sides, each side extending from an adjacent road surface to a bottom side of the channel at an angle of 100 to 170 degrees from the channel bottom;

placing a backer rod within the gap;

filling at least a portion of the gap with a binder;

placing a plate over the gap;

positioning flexible material over the plate and extending beyond the plate in each direction, wherein opposing ends of the flexible material contact the channel bottom;

covering the flexible material, the channel bottom and at least a portion of the sides of the channel with at least one layer of aggregate chips and a binder so as to fill the channel to at least the top of the road surface;

wherein the flexible material is comprised of a heat resistant and pliable plastic.

2. The method of claim 1 further comprising compacting the one or more layers of aggregate chips and binder.

3. The method of claim 1 wherein the two non-parallel sides join to the bottom of the channel at an angle of 120 to 150 degrees.

4. The method of claim 1 wherein the binder below the plate and the binder above the plate is the same material.

5. The method of claim 1 wherein the flexible material is neoprene.

6. The method of claim 1 further comprising placing a top coating over the uppermost layer of aggregate chips and binder.

7. A method of claim 6 wherein the top coating extends laterally beyond the uppermost layer of aggregate chips and binder and onto each of the two adjacent road surfaces.

8. The method of claim 1 wherein the aggregate chips have a size such that at least 90% by weight of the chips pass through a ⅞" sieve.

9. The method of claim 1 wherein the binder is an asphalt based elastomeric material that contains thermal plastic polymers.

10. The method of claim 1 further comprising adding additional binder to one or more of the at least one layers of aggregate chips and binder after placing of the layer into the channel, but prior to adding any additional layer of aggregate chips and binder.

11. The method of claim 1 further comprising adding an anti-skid material over the top of a filled expansion joint.

12. A bridge joint comprising:

a channel having two non-parallel sides formed by bridge material and joined to the bottom of the channel at an obtuse angle;

a gap at the bottom of the channel;

a backer rod within the gap;

a plate extending over the backer rod;

a flexible sheeting extending over the plate and beyond the plate in each direction, wherein opposing ends of the flexible sheeting contacts the channel bottom;

at least one binder layer covering the plate, the bottom and at least a portion of the sides of the channel; and one or more layers containing aggregate chips and binder covering the at least one binder layer.

13. The bridge joint of claim 12 wherein the flexible sheeting is positioned to allow lateral movement of the plate relative to the at least one layer of aggregate chips and binder.

14. The bridge joint of claim 12 wherein the two sides join to the bottom at an angle of 110-150 degrees.

15. The bridge joint of claim 12 wherein the flexible sheeting is comprised of a heat resistant and pliable plastic.

16. The bridge joint of claim 12 further comprising a top coating covering the uppermost layer of aggregate chips and binder.

17. The bridge joint of claim 12 wherein the channel is at least 20 inches wide and at least 2 inches deep.

18. The bridge joint of claim 12 wherein the plate is comprised of aluminum, galvanized steel, stainless steel, or zinc oxide coated steel.

19. The bridge joint of claim 12 wherein the plate contains at least one locating pin positioned through the plate and into the backer rod.

20. A bridge joint comprising:

a channel having two non-parallel sides formed by bridge material and joined to the bottom of the channel at an obtuse angle;

a gap at the bottom of the channel;

a backer rod within the gap;

a binder filling at least a portion of the gap above the backer rod;

a plate extending over the backer rod;

a flexible sheeting extending over the plate and beyond the plate in each direction, wherein opposing ends of the flexible sheeting contacts the channel bottom; and one or more layers containing a binder and aggregate chips covering the flexible sheeting, the channel bottom and at least a portion of the two non-parallel sides of the channel;

wherein the binder below the plate and the binder above the plate is the same material.

* * * * *